US012662789B2

(12) United States Patent
West et al.

(10) Patent No.: US 12,662,789 B2
(45) Date of Patent: Jun. 23, 2026

(54) SYSTEMS, METHODS, AND MACHINES FOR CONSTRUCTING SOLAR FOUNDATIONS

(71) Applicant: Ojjo, Inc., San Rafael, CA (US)

(72) Inventors: Jack West, San Rafael, CA (US); Charles Almy, Berkeley, CA (US); Steven Kraft, Albany, CA (US); Ian Capsuto, Berkeley, CA (US); Tyrus Hudson, Petaluma, CA (US)

(73) Assignee: OJJO, INC., San Rafael, CA (US)

( * ) Notice: Subject to any disclaimer, the term of this patent is extended or adjusted under 35 U.S.C. 154(b) by 125 days.

(21) Appl. No.: 18/371,279

(22) Filed: Sep. 21, 2023

(65) Prior Publication Data

US 2024/0011234 A1 Jan. 11, 2024

Related U.S. Application Data

(62) Division of application No. 17/150,724, filed on Jan. 15, 2021, now abandoned.

(60) Provisional application No. 62/961,383, filed on Jan. 15, 2020.

(51) Int. Cl.

| | |
|---|---|
| ***E02D 5/28*** | (2006.01) |
| ***E02D 5/80*** | (2006.01) |
| ***E02D 7/26*** | (2006.01) |
| ***E02D 27/12*** | (2006.01) |
| ***E02D 27/32*** | (2006.01) |

(52) U.S. Cl.

CPC ..... *E02D 5/28* (2013.01); *E02D 5/80* (2013.01); *E02D 7/26* (2013.01); *E02D 27/12* (2013.01); *E02D 27/32* (2013.01)

(58) Field of Classification Search

CPC .... E02D 5/28; E02D 5/80; E02D 7/26; E02D 27/12; E02D 27/32

See application file for complete search history.

(56) References Cited

U.S. PATENT DOCUMENTS

| | | | | |
|---|---|---|---|---|
| 3,380,205 A | | 4/1968 | Ratchford | |
| 3,830,024 A | | 8/1974 | Warnke | |
| 4,058,985 A | | 11/1977 | Liddell | |
| 5,662,175 A | * | 9/1997 | Warrington | E02D 7/10 173/132 |

(Continued)

FOREIGN PATENT DOCUMENTS

| | | |
|---|---|---|
| JP | 2004300846 A | 10/2004 |
| JP | 2009046832 A | 3/2009 |

(Continued)

OTHER PUBLICATIONS

International Search Report dated Jun. 10, 2021 (13 pages) for PCT/US2021/013707.

*Primary Examiner* — Kyle Armstrong

(74) *Attorney, Agent, or Firm* — Fredrikson & Byron, P.A.

(57) ABSTRACT

Improved masts for solar pile driving machines are provided that incorporate inline drilling as well as alignment and assembly devices that enable greater positional accuracy than possible with conventional equipment. In some cases, a jig, holder, or other device on the mast of the machine can be used to place a bearing assembly for a single-axis tracker while the foundation is being installed. Also disclosed are various multi-piece foundation piles that enable positional adjustment between below and above-ground components to compensate for misalignment.

10 Claims, 12 Drawing Sheets

(56) References Cited

U.S. PATENT DOCUMENTS

| | | | | |
|---|---|---|---|---|
| 6,942,430 | B1 | 9/2005 | Suver | |
| 7,387,173 | B2 * | 6/2008 | Jinnings | E02D 7/10 173/147 |
| 8,844,209 | B1 | 9/2014 | Oliver et al. | |
| 9,458,593 | B2 | 10/2016 | Hale | |
| 9,611,611 | B2 | 4/2017 | Klekotka et al. | |
| 10,310,054 | B2 * | 6/2019 | Troy | G01S 5/16 |
| 10,563,370 | B2 | 2/2020 | Savinkoff et al. | |
| 2012/0042600 | A1 | 2/2012 | Bacon | |
| 2012/0148349 | A1 * | 6/2012 | Grover | E02D 13/04 405/232 |
| 2016/0356294 | A1 | 12/2016 | Fenwick et al. | |
| 2017/0268336 | A1 | 9/2017 | Yoon | |

FOREIGN PATENT DOCUMENTS

| | | | | |
|---|---|---|---|---|
| JP | 2016217021 | A | * | 12/2016 |
| JP | 6482145 | B2 | | 3/2019 |
| KR | 200119385 | Y1 | | 3/1998 |
| KR | 1020100023089 | A | | 3/2010 |
| KR | 2020100005225 | U | | 5/2010 |
| KR | 101723512 | B1 | | 4/2017 |
| KR | 101742438 | B1 | | 6/2017 |
| KR | 101861120 | B1 | | 5/2018 |
| WO | 9518270 | A1 | | 7/1995 |

* cited by examiner

SYSTEMS, METHODS, AND MACHINES FOR CONSTRUCTING SOLAR FOUNDATIONS

CROSS-REFERENCE TO RELATED APPLICATIONS

This is a divisional of U.S. utility patent application Ser. No. 17/150,724 which claims priority to U.S. provisional patent application no. 62/961,383 filed on Jan. 15, 2020, titled "SYSTEMS, METHODS AND MACHINES FOR DRIVING H-PILES", the disclosures of which are hereby incorporated by reference in their entirety.

BACKGROUND

Until recently, so-called H-piles (galvanized steel beams with an I or H-shaped profile) have dominated the foundation market for single-axis solar trackers. They are a brute force approach to the problem but are relatively easy to install with a vibratory or percussive pile driving rig. Also, they present a uniformly dimensioned interface for tracker makers to design to. However, despite their widespread use, they suffer from many limitations. First, they must be overbuilt to withstand the strong bending moments imparted from lateral wind loads on the array, requiring more steel than is necessary to support these loads. Second, their one-piece construction severely limits the ability to compensate for any misalignment suffered while driving. Thirdly, the techniques and machines used to drive them have remained relatively static, and as a result, they often require expensive positional mitigation before the tracker system can be attached to them. In light of these shortcomings, various embodiments of this disclosure seek to improve upon conventional H-piles and the various systems, method and machines used to drive them.

DETAILED DESCRIPTION

The following description is intended to convey a thorough understanding of the embodiments described by providing a number of specific embodiments and details involving A-frame foundations used to support single-axis solar trackers. It should be appreciated, however, that the present invention is not limited to these specific embodiments and details, which are exemplary only. It is further understood that one possessing ordinary skill in the art in light of known systems and methods, would appreciate the use of the invention for its intended purpose.

Figure 1:
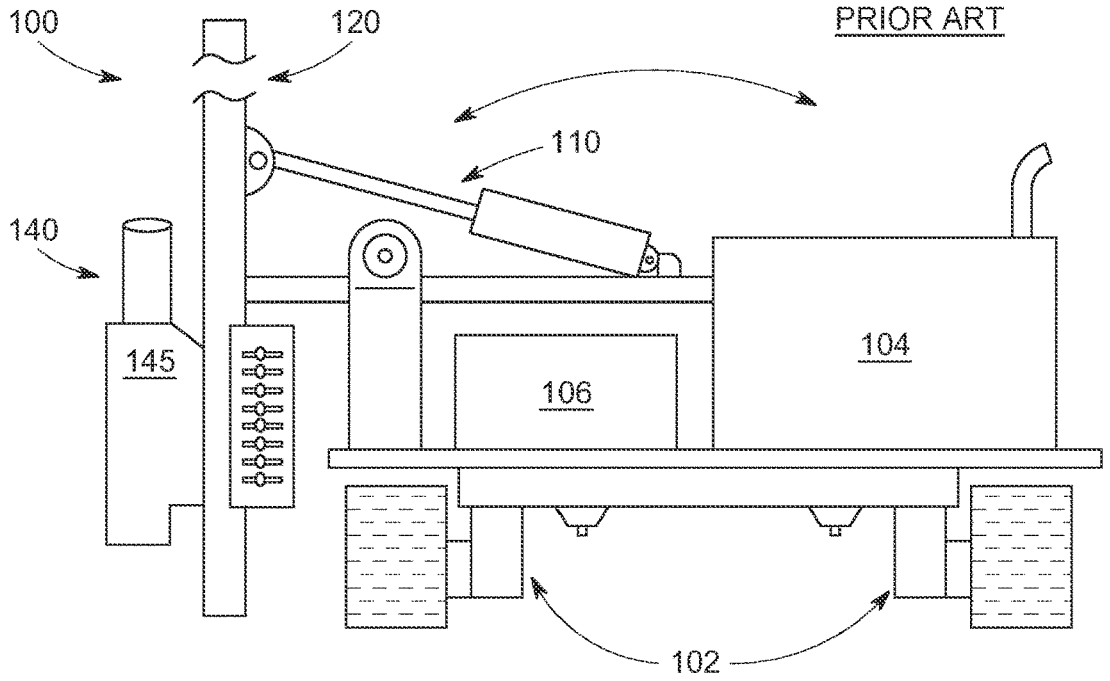
FIG. 1 shows a conventional solar pile driving machine.

Turning now to FIG. 1, this figure shows conventional solar pile driving rig 100. As shown, rig 100 is a small piece of heavy equipment riding tracked chassis 102. Typically, such a rig includes motor or engine 104 and fuel tank 106 and large articulating mast 120 projected high above the rest of the machine. The mast contains the weight or vibratory hammer that applies force to the head of a pile to drive it into the ground. Solar pile driving rigs differ from conventional pile driving rigs in that they are typically sized smaller to match the relatively short length of piles used to support solar arrays (~<12-feet) and have their mast oriented to the side of the machine because they drive piles in straight rows instead of tight clusters. Mast 120 is attached to machine 100 via movable arm 110 so that it can self-level, compensate for uneven terrain, and even move 90-degrees to a stowed position to minimize its size for transport. Solar pile driving machines are usually powered by a small to medium-sized diesel motor that provides motive power as well as power for the hydraulic system. Rig 100 drives piles by impacting and/or vibrating the head of an H-pile with a vibratory or percussive driver that imparts blows to it several times per second, causing the pile to steadily embed into the underlying ground.

Figure 2:
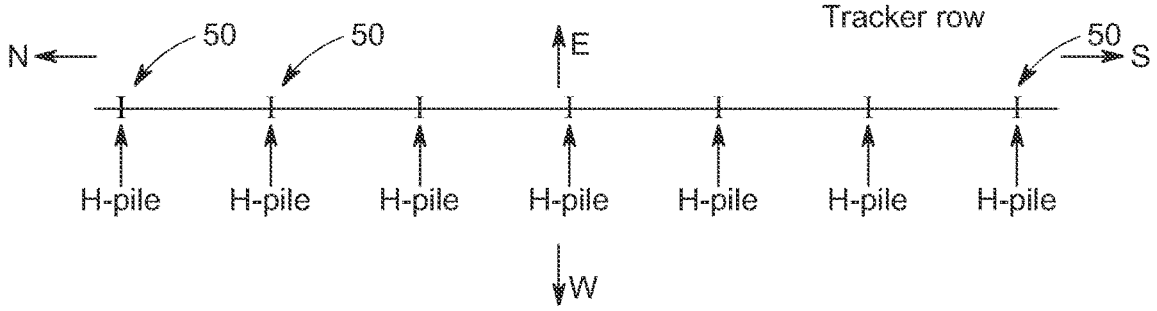
FIG. 2 shows a row of H-pile foundations for a single-axis tracker.

FIG. 2 shows a portion of a row of a single-axis tracker that has been finished with seven H-pile foundations. The row is oriented along a North-South axis so that as the torque tube rotates, the attached solar panels will track the sun's movement through the sky from East-facing to West-facing each day. The rows must be spaced apart from one another to prevent one from shading the other, so the machine typically creates a de-facto path between adjacent rows that is used by contractors completing the installation, and later, if applicable, by mowers or other equipment used to control vegetation. Each H-pile 50 is driven so that it is strongest in the East and West directions since that is the direction subject to the greatest lateral loads. This is accomplished by driving each pile so that the web between the opposing flanges is oriented along an East-West line with the flanges facing East and West. The H-pile, typically a W6×9 or W6×12 standard galvanized beam, presents a dimensionally uniform interface for tracker makers to design too. The particular pile used at each foundation location is determined by the top of pile loads specified by the tracker maker and the soil conditions of the site. Once the H-piles are driven, the contractor installing the tracker system may begin to construct the tracker (i.e., attaching bearings, motors, toque tube, dampers, and solar panels).

Figure 3:
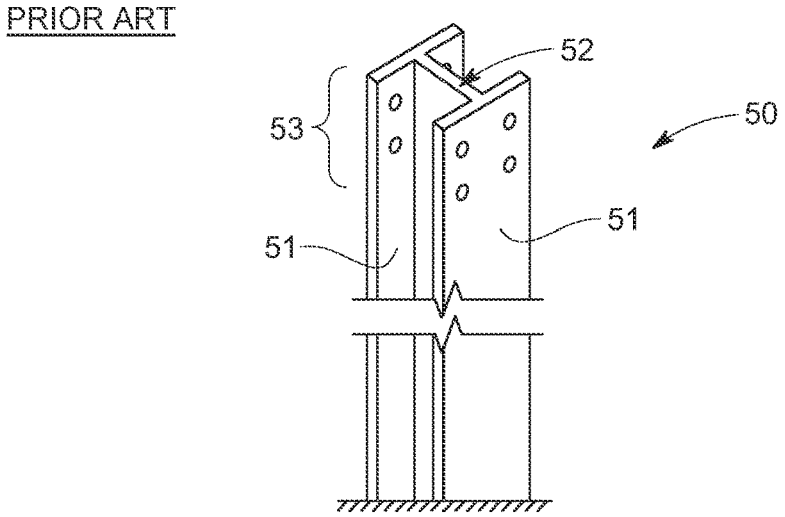
FIG. 3 shows a driven H-pile foundation.
Figure 4:
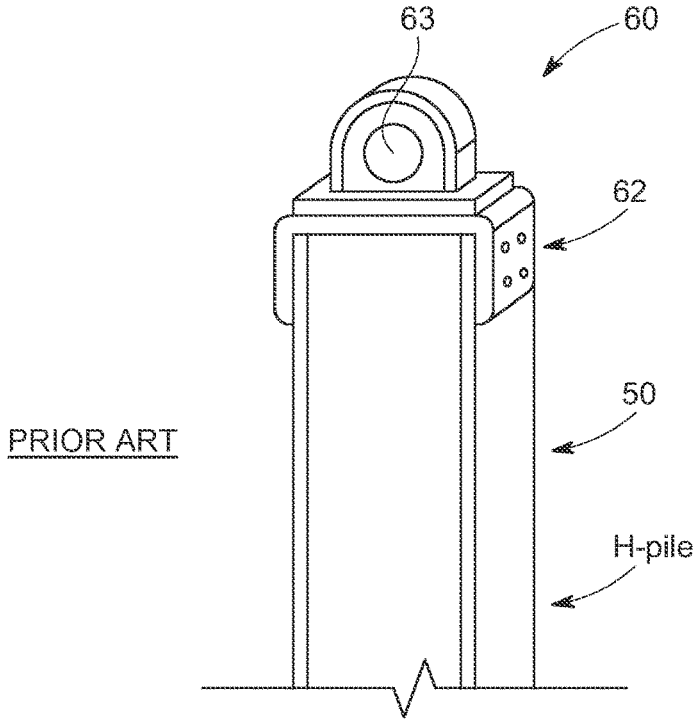
FIG. 4 shows a driven H-pile foundation with a pile cap and bearing assembly.

FIG. 3 shows one of the driven H-piles 50 of the tracker row shown in FIG. 2 and FIG. 4 shows the same pile with a tracker bearing assembly 60 attached to the top of it. Bearing assembly 60 in this example consists of pile cap 62 and a torque tube bearing 63. Pile cap 62 has a pair of opposing flanges that fit over the outer surface of flanges of pile 50. Attachment is made via pre-drilled holes in the upper end of the H-pile. In some cases, a conventional bolt and nut may be used to connect them. In others, a huck-style bolt, rivet, or other fastener may be used.

Figure 5A:
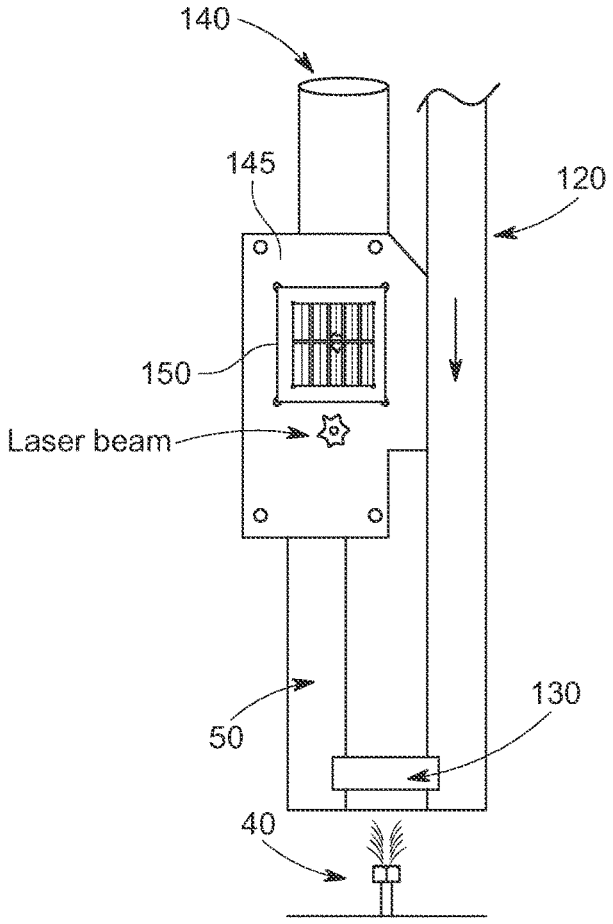
FIG. 5A shows a mast of a solar pile driving machine according to various embodiments of the invention.

When developing a single-axis tracker site, before any H-piles can be driven, a surveyor prepares a site survey in conjunction with a tracker plan, marking the spot of each planned foundation penetration with a flag, post, or whisker. One such device 40 is shown in FIG. 5A. With all markers in place, the pile driving crew can begin driving piles. An operator navigates the driving machine until mast 120 is positioned proximate to marker 40 with the driving axis of the mast leveled over the marker. Then, an H-pile, such as H-pile 50 is stood up on its end and loaded into driver 140. The operator actuates the driver to begin driving it straight down until the desired embedment depth is reached. When finished, driver 140 is withdrawn back up mast 120 and the machine moved proximate to the next foundation marker.

As discussed above, although monopiles are relatively simple to work with, a single component provides no opportunity to remedy misalignment that occurs during driving. For example, if the pile gets off of the intended driving axis, leaning in one direction, twisted, or driven off the intended tracker row, the upper end of the pile may be beyond the tracker maker's tolerance. This can damage the tracker or make it impossible to install without some sort of post driving remediation. It is not uncommon for a remediation crew to go through the site after all the piles are driven to bump or adjust piles that are out of tolerance.

The applicant of this disclosure has developed a novel alternative to plumb driven monopile foundations that uses a pair of adjacent legs driven into the ground at angles to one another and joined above ground with an adapter, truss cap or bearing adapter. Known commercially as EARTH TRUSS, this system translates lateral loads striking a solar array into axial forces of tension and compression. Because single structural members are relatively good at resisting axial loads, less steel may be used to support the same sized array and shallower embedment depths may be employed than is possible with H-piles.

In the EARTH TRUSS system, each truss leg is made of two components: a screw anchor driven into the ground and an upper leg section attached to a coupler at the above-ground end of the screw anchor. To assembly one truss, a pair of adjacent screw anchors are driven into the ground and then a jig or holder on the driving machine is used to hold the apex hardware (e.g., adapter, truss cap, or bearing adapter), at the correct orientation to match others in the same row. The adapter has a pair of connecting portions that extend down and away, pointing toward the driven screw anchors. An upper leg, consisting of a section of hollow tube, is sleeved over each connecting portion and down onto one of the screw anchor couplers. A crimper or other tool is used to secure these interconnections. The hollow nature of the screw anchors enables the use of a unique machine that eliminates pre-drilling steps by employing a drilling tool such as a hydraulic drifter and a rotary driver on the same mast. The drilling tool passes a drill rod through the rotary driver and screw anchor while the screw anchor is being rotated into the ground. Although EARTH TRUSS may not replace H-piles for all single-axis tracker installations, elements of this system and the machine used to drive it may be adapted to improve outcomes and reduce cycle times when using H-piles. <ready to install tracker>

Figure 5B:
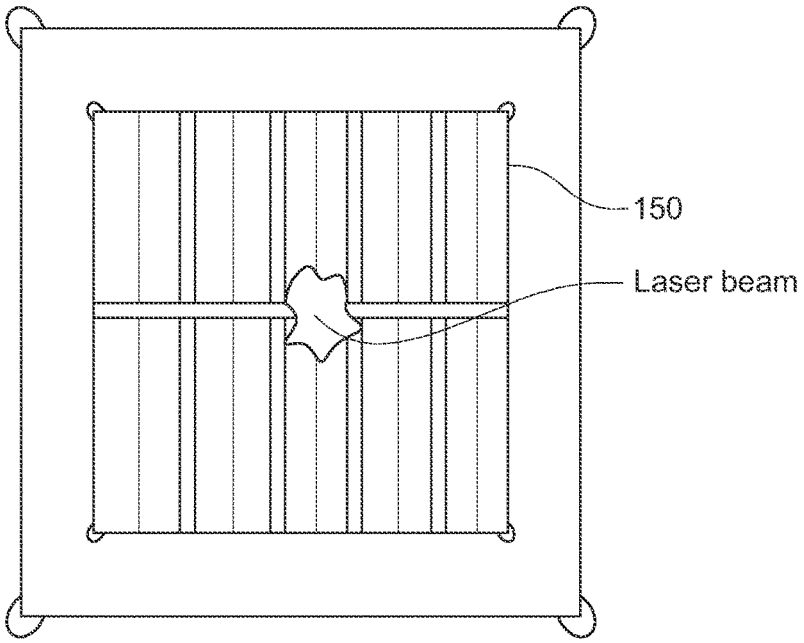
FIGS. 5B and 5C shows a portion of a mast of a solar pile driving machine including a laser target and an impinging laser beam respectively according to various embodiments of the invention.
Figure 5C:
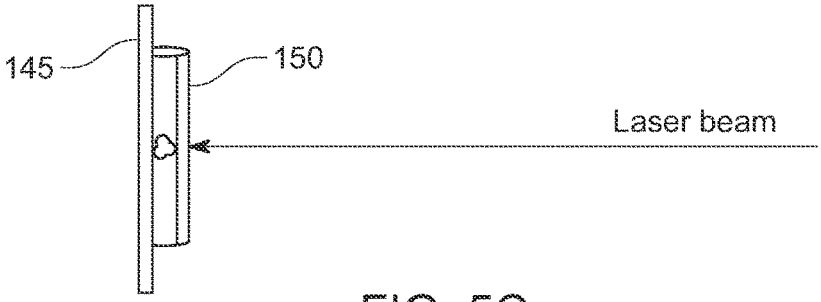

To that end, referring now to FIGS. 5A-C, these figures show mast 120 of a pile driving machine according to various embodiments of the invention. The mast 120 of this machine includes laser target 150 attached to cover 145 of pile driver 140. In various embodiments, a stationary laser is set up at the end of the row to impinge a beam along a line parallel to the torque tube's intended axis or the rotational axis of the tracker. The center of the target may be positioned a known fixed distance from the top of the pile. As driver 140 continues to drive pile 50 into the ground, when the center of the target overlaps with impingent laser beam, the operator may stop the driver to preserve the orientation. If the target is set up at the end of the row, this will ensure that each pile is driven to be consistent in the Z-direction (height). X-direction orientation is dictated by the marker, and self-leveling corrects for pitch and roll.

In the system shown in FIGS. 5A-C, a laser is set up at end of the row and oriented with a receiver at the opposing end. Once the beam is properly adjusted, an operator moves the machine to the first foundation location and uses the beam to ensure that the mast is properly oriented in the Y-direction. If not, a Y slide may be engaged to pull the mast, and by extension the target, closer to or further away from the machine. Once aligned, a pile is stood up and loaded into the driver. An operator then energizes the driver to begin driving until the laser pattern impinging on the cover reaches the center of the target. Alternatively, a sensor may be placed at the center of the target that causes the driver to stop when the laser is on-target.

As discussed herein, in the typical case, the foundation contractor drives all the H-piles before the tracker installer can begin installing the tracker components. In some cases, it may be advantageous to install tracker bearing assembly components at the same time as driving the H-pile. The reason being that the position of the H-pile relative to other piles in the row is known at that point and the laser alignment is already set up. If the bearing assembly is installed at a later time, it will likely require setting up another laser to re-establish a reference position. This will speed up subsequent tracker installation and eliminate the need for pre-construction remediation. To take advantage of the fact that the machine is already properly aligned with respect to a reference after driving a pile, various embodiments of the invention provide a jig, holder, or other device attached to the mast and/or pile driver assembly for enabling precise placement of apex components (pile cap, bearings, etc.) right after the pile is driven so that when the foundation contractor is finished, the tracker installer may proceed directly to assembly without requiring an additional alignment and/or remediation step. This is shown, for example, in FIGS. 6A-D.

Figure 6A:
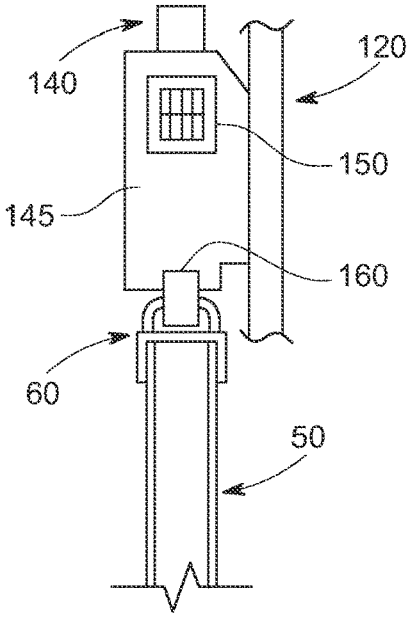
FIGS. 6A-6D show various views of a portion of a mast for a solar pile driving machine including a pile cap holder engaged in a process of installing a pile cap on a driven pile in accordance with various embodiments of the invention.
Figure 6B:
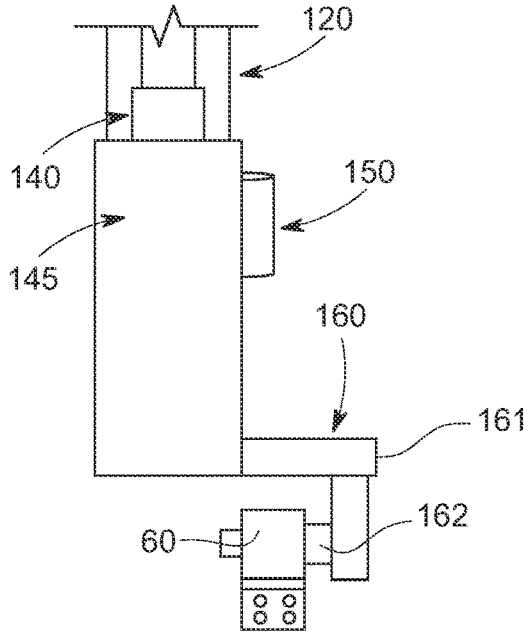
Figure 6C:
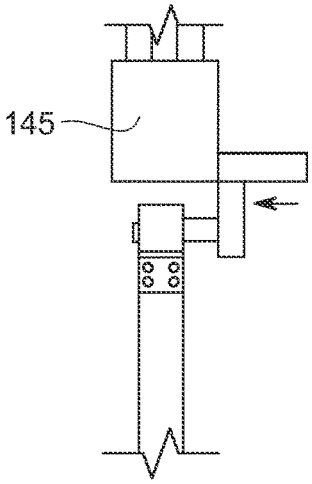
Figure 6D:
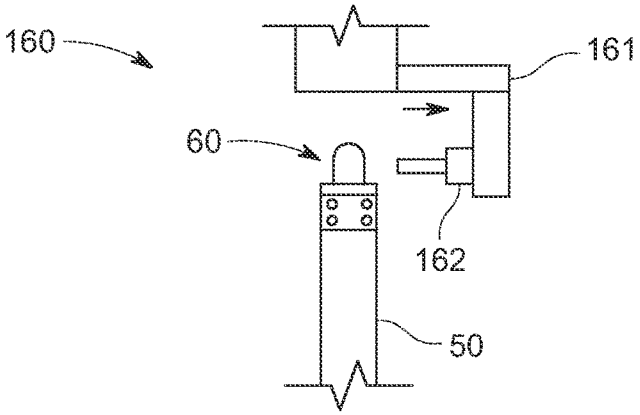

Starting with FIG. 6A, this is a front view of the machine which provides a side view of pile driving mast 120 including driver 140 and cover 145 with target 150. At the lower end of cover 140 is a jig or pile cap holder 160 that is used to hold and orient an adapter, truss cap or bearing assembly so that it can be slid on to the driven H-pile and firmly attached at the proper height and orientation. In various embodiments, after the H-pile is driven, the driver is moved up the mast, either automatically, to a known distance from the latched on-target distance or manually until the impinging laser strikes the correct location on target 150. FIG. 6B is a front view of mast 120 (side view of the machine). As shown in the example of FIGS. 6B-6D, jig or pile cap holder 160 is positioned at the bottom of cover 145 and consists of arm 161 and sliding assembly 162. In various embodiments, sliding assembly 162 has a cylindrical portion that temporarily fits into the bearing to hold the pile cap at the correct height. Then the sliding assembly 162 is slid along the arm 161 until the vertical flanges of the bearing cap 60 reach the flanges of H-pile 50. Before sliding assembly 162 is maximally slid, it should coincide with top of H-pile 50 and the desired placement of the bearing. In various embodiments, pile cap 60 is then attached to pile 50 using two or more bolts, rivets, or other fasteners, that go through the pile cap's and H-pile's overlapping flanges. When the assembly is complete, sliding assembly 162 is slid back away from the installed bearing, leaving behind the completely installed pile with a properly oriented bearing assembly on top. It should be appreciated that other mechanisms may be used to hold the bearing assembly in place while moving it into position over the driven H-pile. The central point is that the aligned mast and driver are used after driving but before the machine is moved to accomplish alignment of the bearing assembly at the same time that the foundation is installed rather than having to perform another alignment step at a later date. Moreover, the alignment system used to orient and drive the pile is also used to assemble the pile cap and bearing and the correct orientation.

Figure 7A:
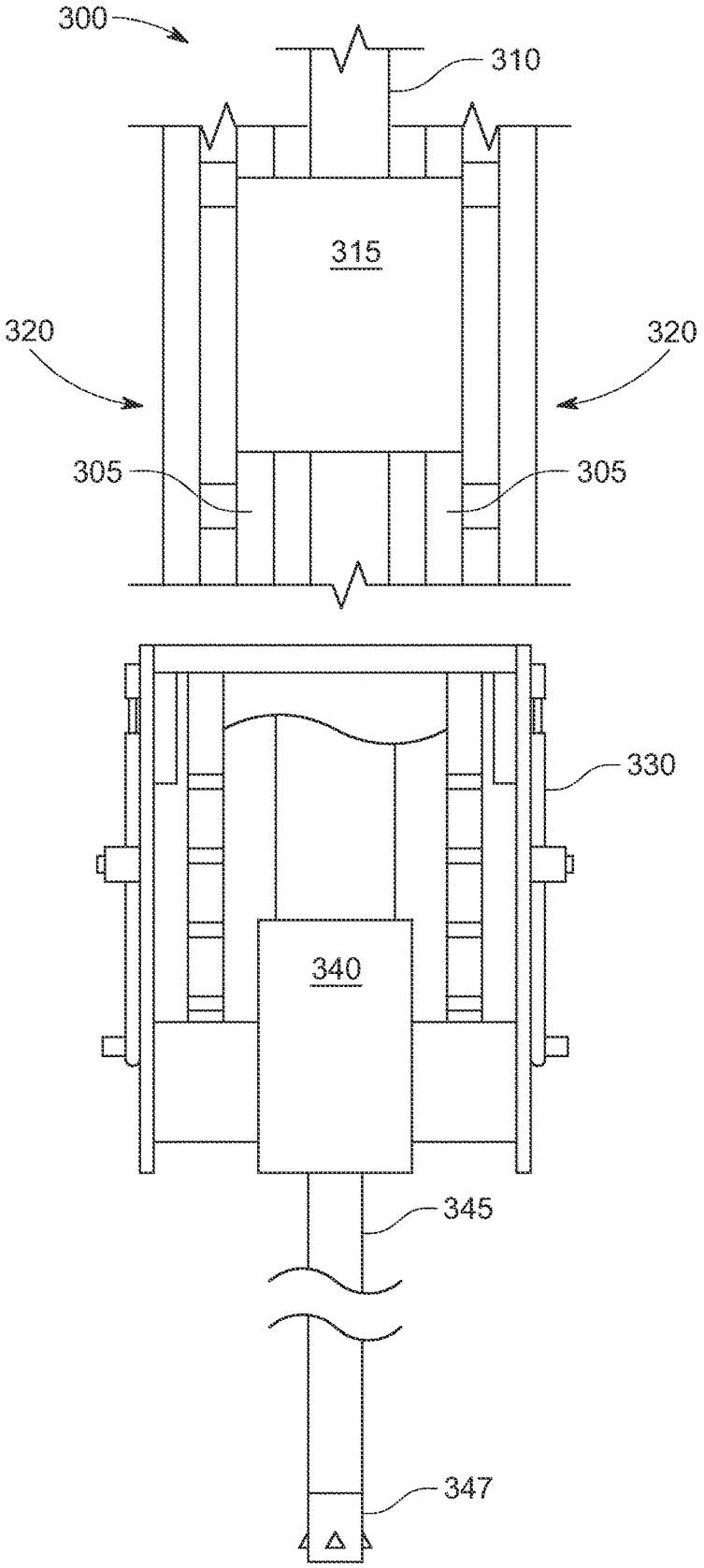
FIGS. 7A-7C show different views of a portion of a mast for another solar pile driving machine including a pile driver and drilling tool according to various embodiments of the invention.
Figure 7B:
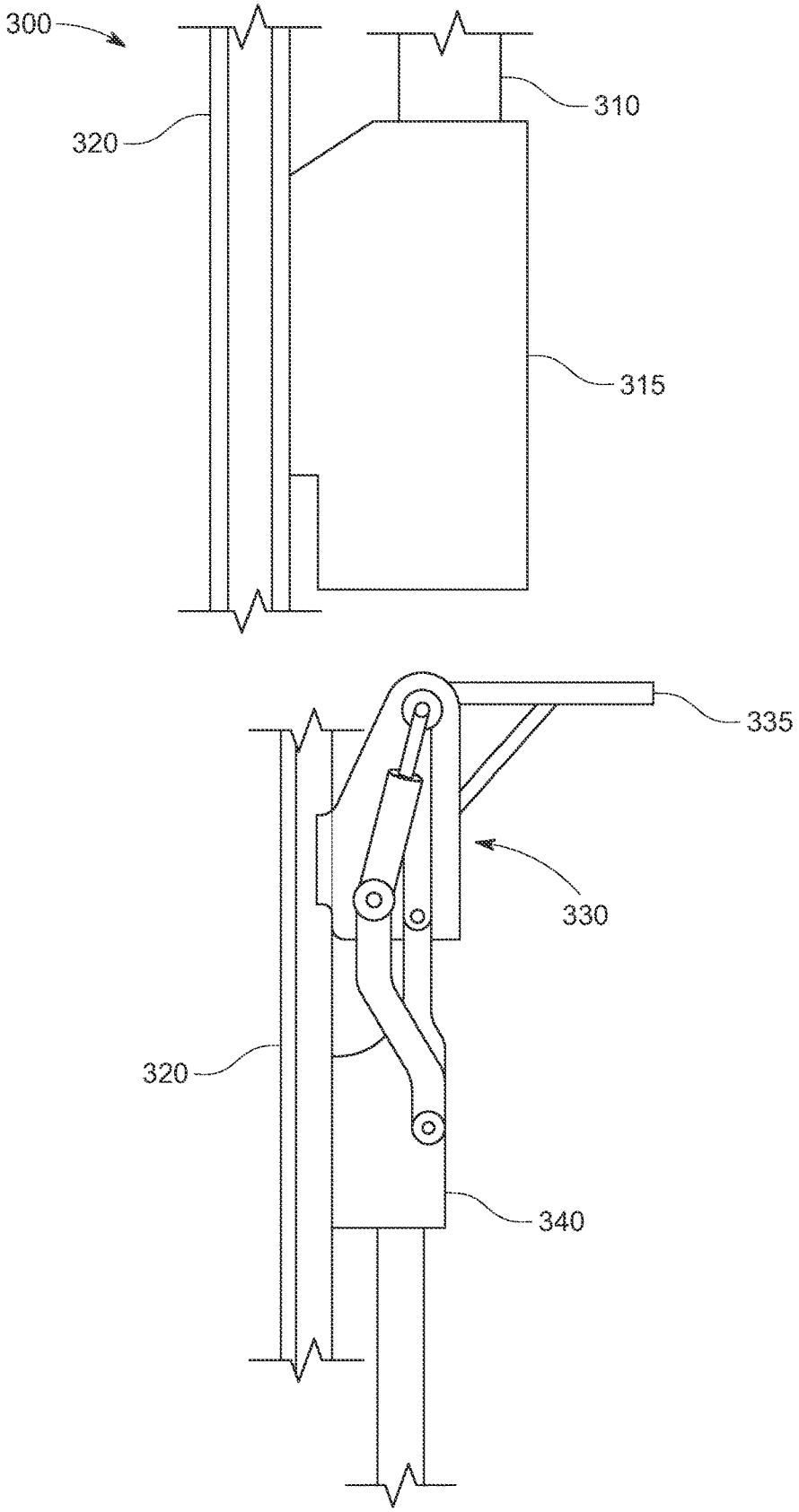
Figure 7C:
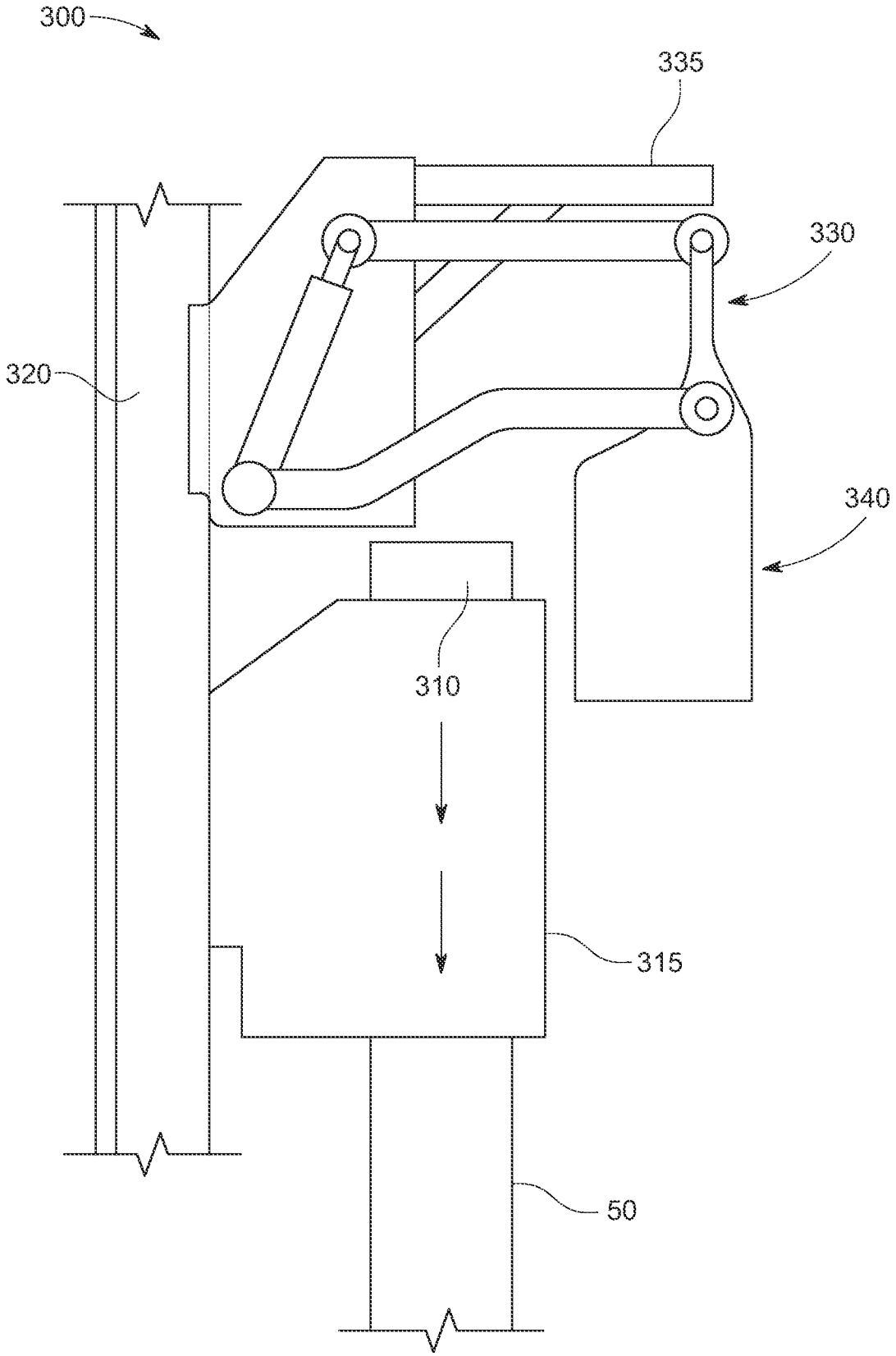

One shortcoming of H-piles is that when they encounter a refusal, a situation where further impacts fail to result in further embedment, an expensive and time-consuming mitigation process is triggered that increases the cost of that foundation by as much as ten-fold. Typically to remediate this situation, the partially driven pile must be removed, a bore hole drilled, back-filled and tamped, and then a new pile driven into the back-filled borehole. Alternatively, grout or cement may be put in the borehole with the beam. To prevent a separate crew having to remediate refused piles, in situations where the soil is known to be difficult, it may be desirable to pre-drill a hole for the pile while the machine is positioned above the desired pile location. To that end, FIGS. 7A-C show a portion of a mast for a pile driving machine that includes a driver and a drilling operable to predrill and drive along the same axis according to various embodiments of the invention.

Starting with 7A, this figure shows a front view of a portion of a mast for a solar pile driving machine according to various embodiments of the invention. Mast 300 shown here includes primary rails 305 and parallel auxiliary rails 320. Rotary driver 310 travels along primary rails 305. In addition, drilling tool 340, which in various embodiments may be a hydraulic drifter or other showing the pile driver and cover which travels up and down the mast via a carriage or crowd that moves along auxiliary rails 320. In various embodiments, and as shown in the figure, drilling tool 340 may be mounted on an articulating four bar assembly such as assembly 330 that enables the tool to be pivoted into and out of the drive axis of rotary driver 310. This geometry is shown more clearly in the mast side views of FIGS. 7B and 7C. By traveling on auxiliary rails 320 outside side of primary rails 305 rotary driver 310 can move past four bar frame assembly 330 and drilling tool 340 when they are pivoted out of the way, as seen in FIG. 7C, without having to move the mast. This is important because predrilling alignment may be preserved, eliminating the need for re-orienting the mast after drilling.

In various embodiments, when drilling tool 340 is being used, pile driver 310 will be moved up the mast out of the way. Drilling tool 340 may be selectively engaged to rotate and hammer as the crowd it rides on travels down the mast. When drilling is complete, the crowd carrying drilling tool 340 is pulled back up mast 300, causing the drill to withdrawal from the borehole. Though now shown, a centralizer or other guide may be placed at the lower end of mast 300 to keep the drill shaft from wobbling. Drilling tool 340 is pivoted of the way by retracting the actuators attached to four-bar assembly 330, causing the assembly to move out, away from the machine, as show in FIG. 7C, so that pile driver 310 may pass by it to drive a pile into the drilled borehole. Assembly 330 may also include movable target 335 that can be selected pivoted up or down to enable orientation of the mast with a laser device at the end of the row.

Figure 8:
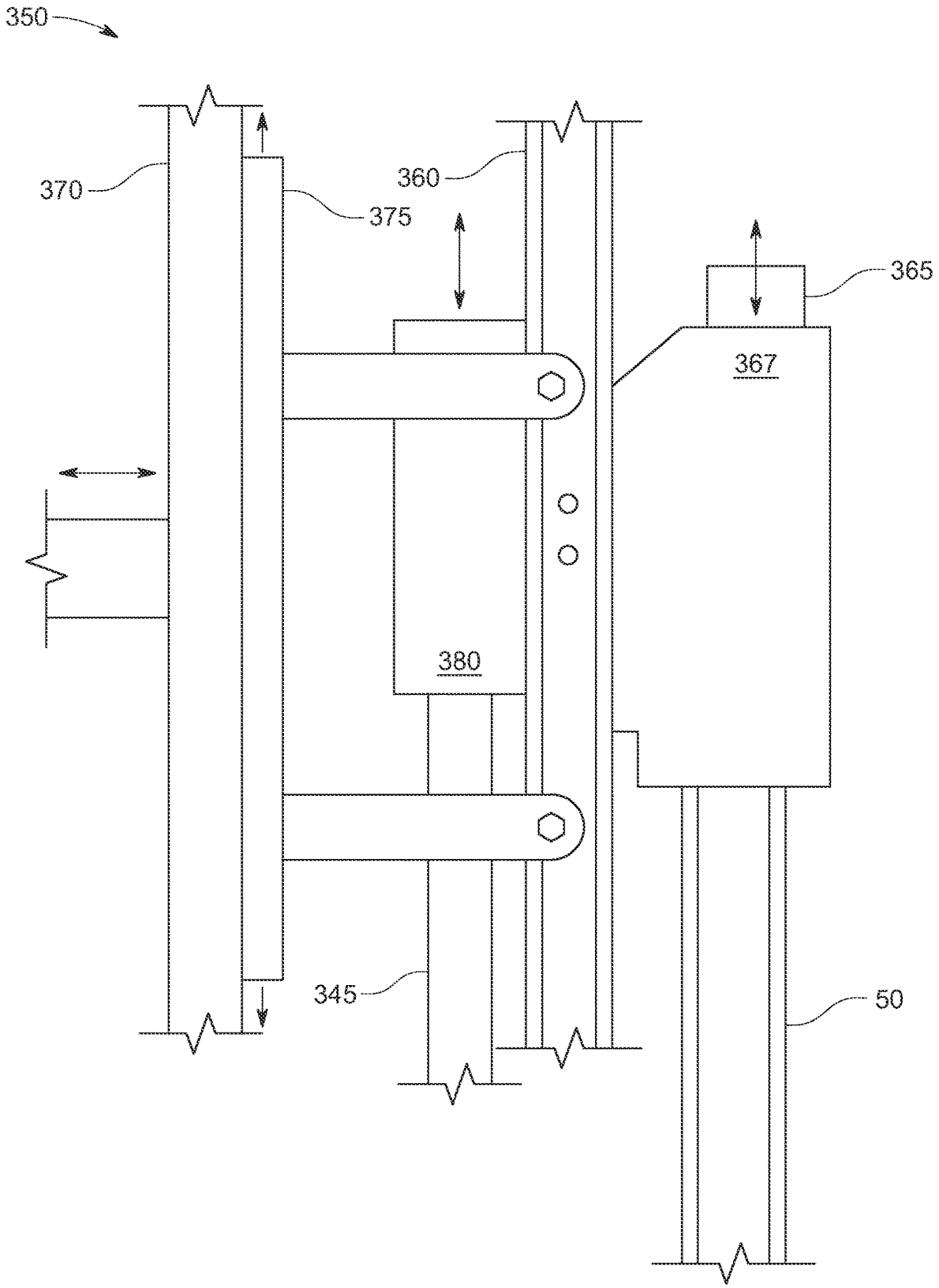
FIG. 8 shows a side view of a portion of yet another mast for a solar pile driving machine including a pile driver and drilling tool according to various embodiments of the invention.

Turning now to FIG. 8, this figure shows a mast for a solar pile driving machine according to various other embodiments of the invention. Mast 350 shown in FIG. 8 is a double mast including primary mast 370 and secondary mast 360. In various embodiments, and as shown in the figure, when slide 375 moves up or down primary mast 370, secondary mast 360 is also moved. Thus, secondary mast 360 may be moved up or down by moving slide 375. Once mast 360 is at the correct height, pile driver 365 and drilling tool 380 may move independent of one another up or down secondary mast 360. In various embodiments, primary mast 370 is connected to its machine via a telescoping mechanism 355 that enables both drilling tool 380 and pile driver 365 to be selectively oriented over the same foundation location depending on which tool needs to be moved.

As discussed herein, H-piles are by design overbuilt because single structural members are poor at resisting bending, and yet that is exactly what they must do in the face of lateral loads. Therefore, heavier steel and deeper driving depths are required relative to trussed foundations. Much of the required beefiness of an H-pile in a solar foundation is the portion that is underground because underground portion is the part subjected to the strongest bending forces. Therefore, to the extent the same sized material is also used above ground, it is unnecessary. That is, the portion of the beam above ground is stronger than it needs to be. For simplicity's sake, this wastage is tolerated. However, by dividing the beam into two pieces, each section may be tailored to the specific load profile and corrosion profile that it will be exposed to. Also, monopiles do not permit adjustments in the same way an interface between two components does. To that end, the remainder of the disclosure is directed to multi-piece piles that include a flexible interface that enables some positional adjustment (e.g., North-South, East-West, leaning, and twisting).

Figure 9A:
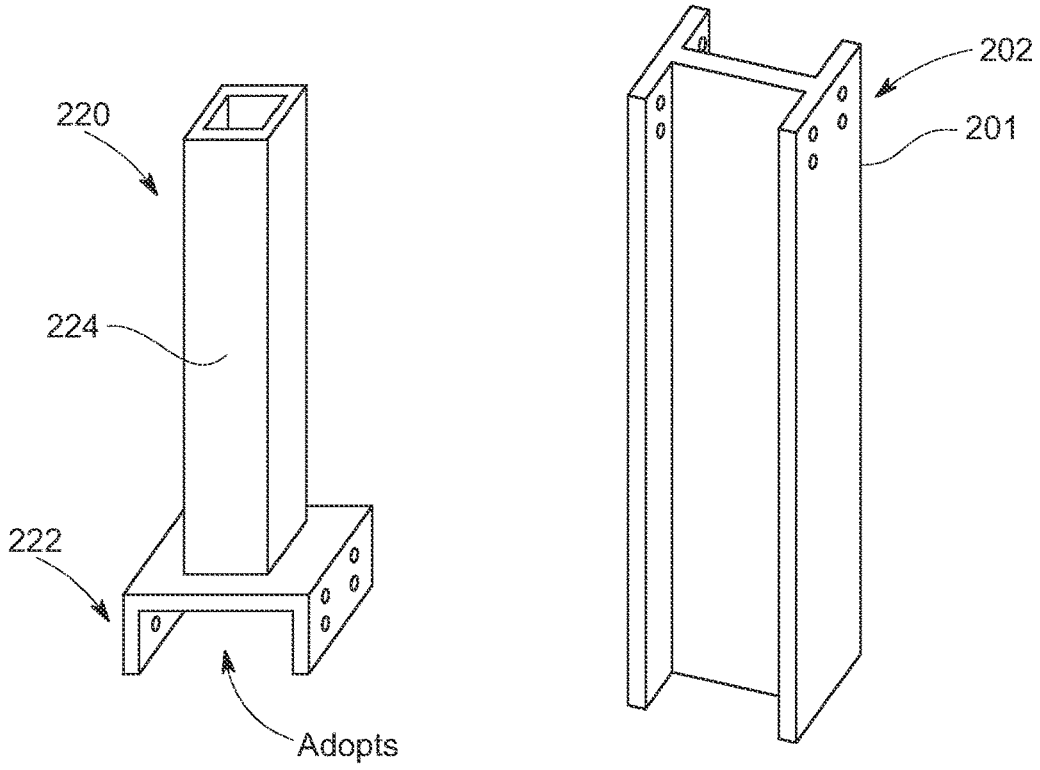
FIGS. 9A and 9B shows different views of a two-piece foundation pile according to various embodiments of the invention.
Figure 9B:
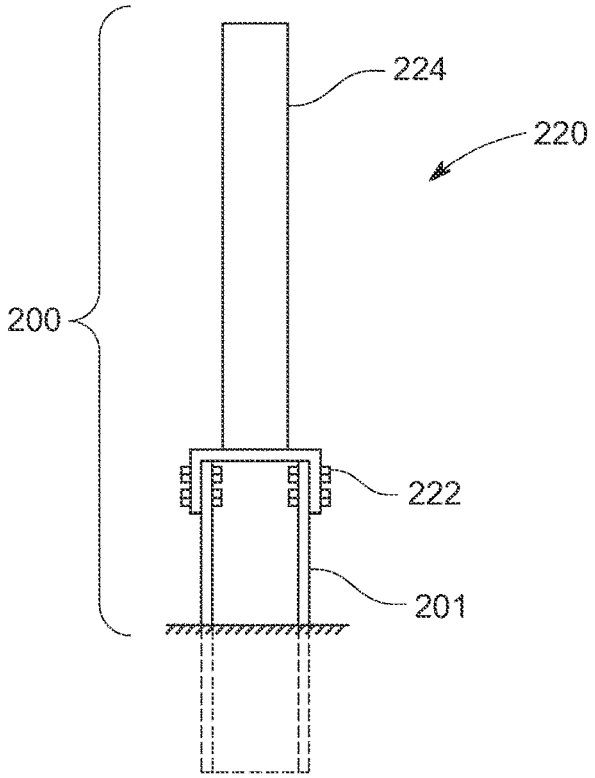

Starting with FIGS. 9A/B, these figures show two-piece pile assembly 200 according to various embodiments of the invention. Assembly 200 consists of heavy, below-ground portion 201 and relatively smaller above-ground portion 220. Below ground portion 201 is a standard H-pile with holes 202 pre-drilled at the upper end. Above-ground portion 220 consists of a section of steel tube 224, in this example with a boxed profile, and flanged adapter 222 at the lower end. In various embodiments, the below-ground portion is driven in the same manner as discussed herein, with a percussive or vibratory pile driver. Once it reaches the calculated embedment depth, which again may be controlled with laser alignment with the target at a known offset from the top of the pile, the above-ground portion may be quickly attached with a huck bolt gun, impact driver or other hand tool. The box-profile of the above-ground portion is exemplary only. It may have a flanged upper end or other geometry that is designed to interface with commercially available tracker systems. Moreover, slots may be used instead of holes 202 to enable adjustment between below-ground portion 201 and above-ground portion 220. 9B shows the combined assembly after pile 201 has been driven into the ground and upper portion 220 attached via flange adapter 222. In addition, a jig, pile cap holder, or other structure may be used at the time of assembly to leave completed two-piece pile 200 with a properly aligned tracker bearing as discussed herein.

Figure 10:
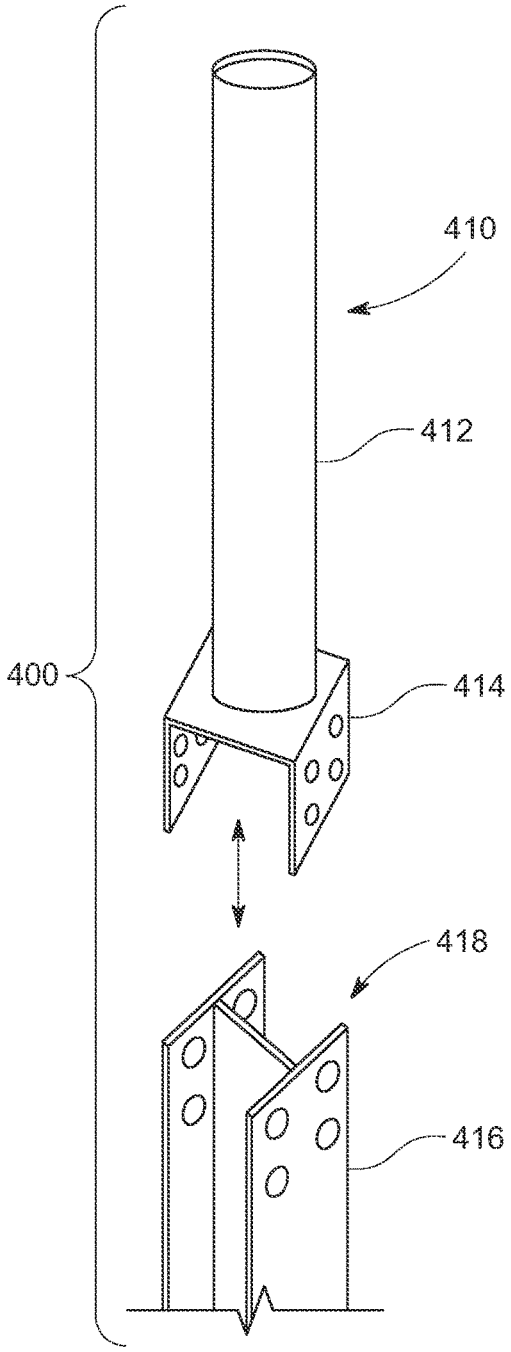
FIG. 10 shows an exploded view of another two-piece foundation pile according to various embodiments of the invention.
Figure 11:
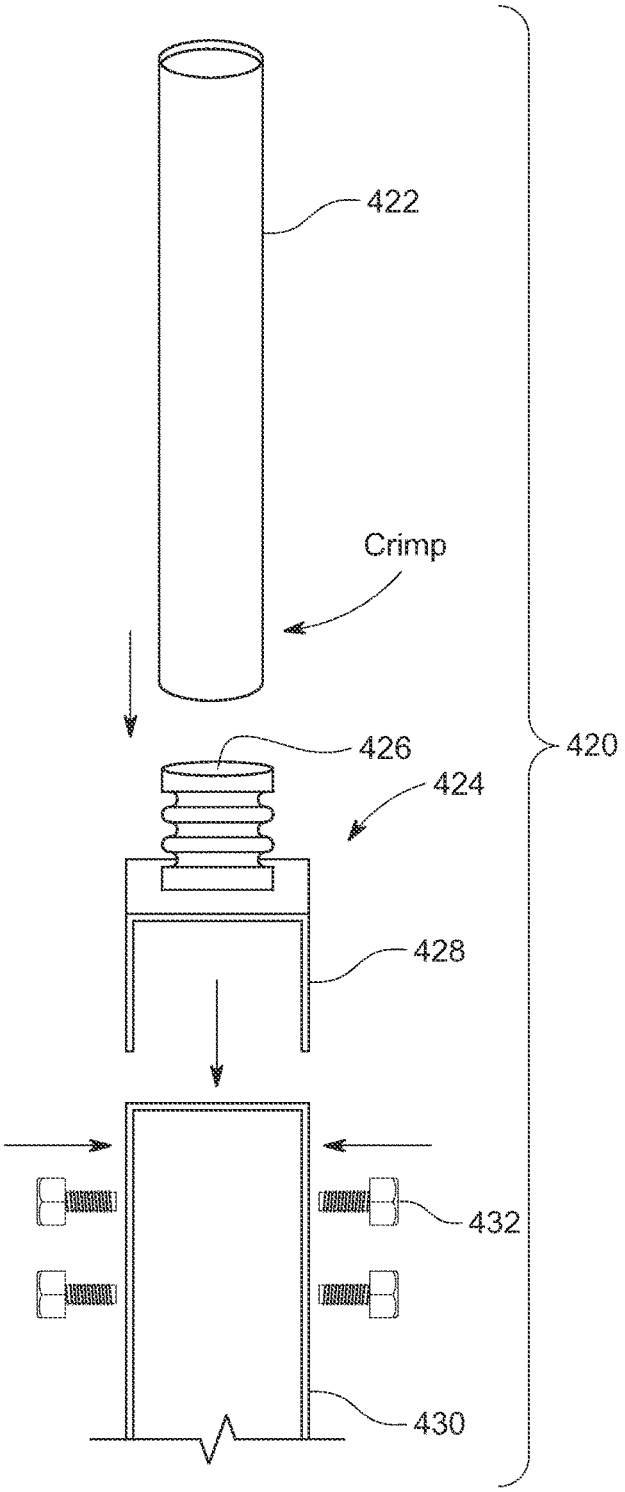
FIG. 11 shows a front view of an additional two-piece foundation pile according to various embodiments of the invention.

Turning to FIGS. 10 and 11, these figures two more multi-piece piles according to various embodiments of the invention. Starting with FIG. 10, pile 400 is constructed from below ground portion 416 which again is a conventional H-pile with a plurality of holes 418 in the upper end of each beam flange. Above ground-portion 410 includes a circular tube of steel 412 and a flanged base adapter 414 that fits over pile 416. The circular profile of above-ground portion 410 eliminates concern of the pile twisting during driving. Regardless of driven pile 416's orientation about its own axis, upper portion 410 will present a uniform interface to support the tracker. The connection between pile 416 and flanged connector 414 is made via bolts or other conventional fasteners. Pile 420 shown in FIG. 11 also relies on conventional H-pile 430 for the below-ground foundation. Then, a flanged crimp coupler 424 is placed on top of driven pile 430. Crimp coupler 424 has a pair of opposing flanges 428 that fit over the top end of pile 430, and a connecting portion 426 projected away from it. In various embodiments, upper portion 422 slides down over connecting portion 426. A crimping tool may then be used to deform upper portion 422 around connecting portion 426 to complete the pile.

Figure 12A:
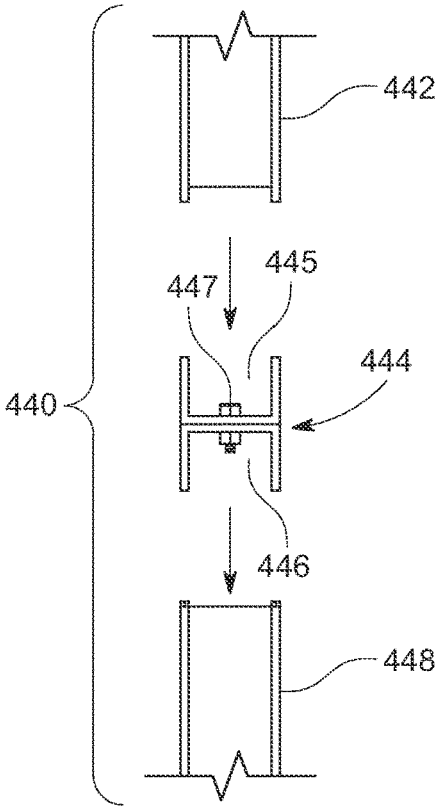
FIGS. 12A and 12B show different views of a multi-piece foundation pile including a double flanged coupler according to various embodiments of the invention.
Figure 12B:
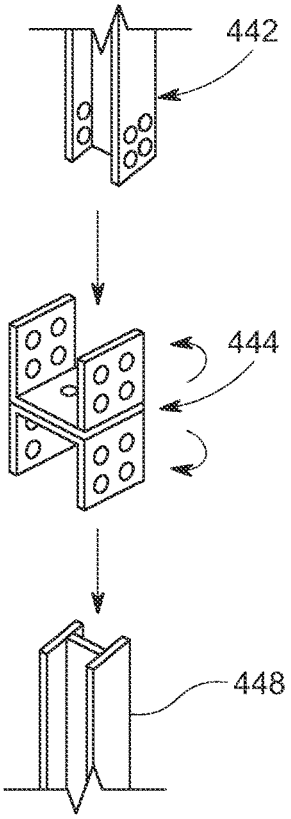

FIGS. 12A and 12B show different views of another multi-piece pile according to various embodiments of the invention. Pile 440 consists of two H-pile sections, one 448 driven below ground and the other 442 fitted above. Double flanged coupler 444 has opposing upper and lower flanged adapters 445, 446 respectively, that receive adjacent end of the lower and upper piles 448, 442. In various embodiments, a pin, rivet, or other fastener 447 joins upper and lower flanged adapters 445, 446 so that they can rotate with respect to one another about an axis passing through the center of both. This enables upper portion 442 to be oriented correct with respect to the North-South row of the tracker (i.e., with the web facing North-South), even if the below-ground portion 448 experiences some twist during driving. Again, bolts, rivets, hucks, or other conventional fasteners may be used to join upper and lower portions 442, 448 to coupler 444. Alternatively, coupler 444 may be welded or otherwise permanently attached to upper portion 442 to reduce the number of required fasteners and speed up installation.

Figure 13A:
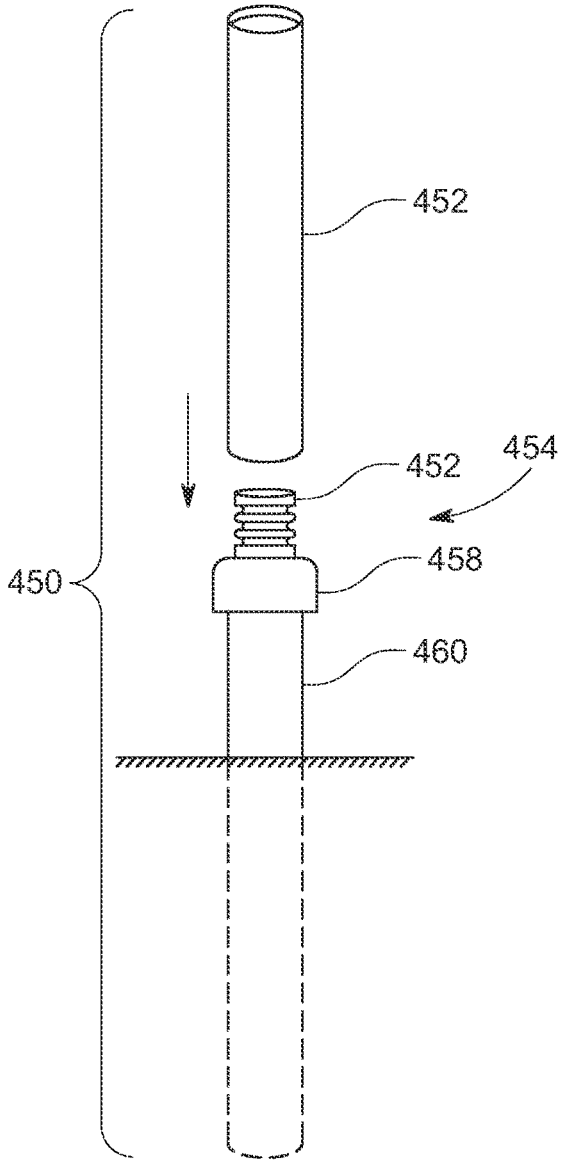
FIGS. 13A and 13B show exploded and connected views of a two-piece foundation pile according to still further embodiments of the invention.
Figure 13B:
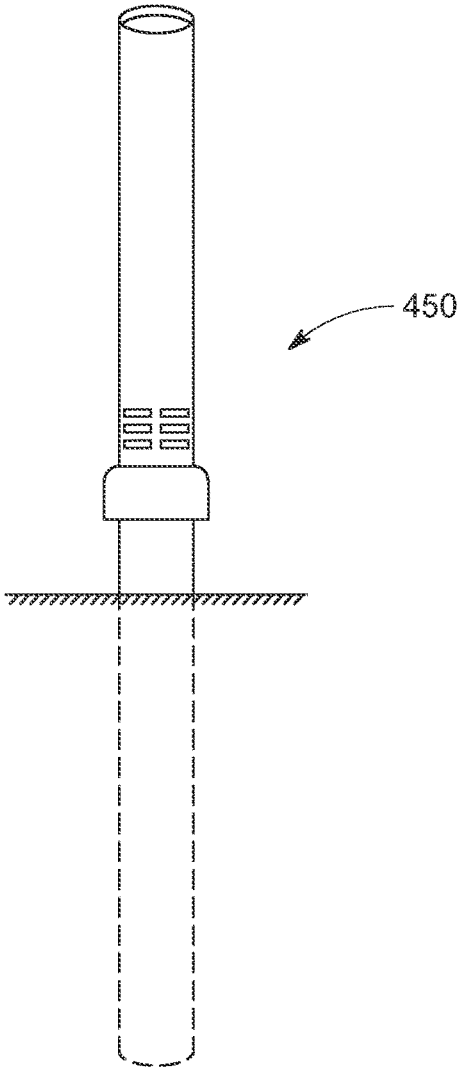

FIGS. 13A and 13B show yet another multi-piece foundation pile according to various embodiments of the invention. Pile 450 consists of below-ground portion 460 which is an elongated section of hollow steel tube. In various embodiments, tube 460 is beaten into the ground with a conventional percussive or vibratory pile driver. Coupler 454 is placed on top of below-ground portion 460 so that collar 458 covers its top end. In some embodiments, this made be done after driving. In others, it may pre-welded onto below-ground portion 460. In such cases, a boot or other device may be fitted over connecting portion 456 of coupler 454 to prevent damage to it during driving. Then, in a manner similar to that of upper portion 422 of pile 420, upper portion 452 is sleeved over connecting portion 456 and crimped in place. Alternatively, upper portion 452 may have internal threads that are used to screw upper portion onto coupler 454.

The embodiments of the present inventions are not to be limited in scope by the specific embodiments described herein. Indeed, various modifications of the embodiments of the present inventions, in addition to those described herein, will be apparent to those of ordinary skill in the art from the foregoing description and accompanying drawings. Thus, such modifications are intended to fall within the scope of the following appended claims. Further, although some of the embodiments of the present invention have been described herein in the context of a particular implementation in a particular environment for a particular purpose, those of ordinary skill in the art will recognize that its usefulness is not limited thereto and that the embodiments of the present inventions can be beneficially implemented in any number of environments for any number of purposes. Accordingly, the claims set forth below should be construed in view of the full breath and spirit of the embodiments of the present inventions as disclosed herein.

The invention claimed is:

1. A pile driving machine comprising:

a motorized tracked chassis;

a mast movably attached to the tracked chassis;

a pile driver assembly comprising a rotary driver that is operable to move along the mast and to drive a pile into the ground along a driving axis;

a drilling instrument that is operable to move between a first orientation overlapping with the driving axis of the rotary driver and a second orientation offset from the driving axis of the rotary driver;

a target on a portion of the pile driver assembly; and a pile cap holder attached to the pile driver assembly, the pile cap holder operable to orient a pile cap over a driven pile at a position relative to a reference on the target.

2. The machine according to claim 1, wherein the pile cap comprises a bearing for a torque tube of a solar tracker.

3. The machine according to claim 1, further comprising a drilling instrument operable to move along the mast independent of the pile driver assembly.

4. The machine according to claim 2, wherein the drilling instrument comprises a hydraulic drifter.

5. The machine according to claim 1, wherein the drilling instrument is operable to move between the first and second orientations via a four-bar frame assembly.

6. The machine according to claim 1, further comprising a laser impinging a laser beam on the target.

7. The machine according to claim 1, wherein the pile cap holder is attached to the rotary driver.

8. The machine according to claim 1, wherein the mast comprises primary rails and auxiliary rails parallel to and outside of the primary rails, wherein the rotary driver is movable along the mast at least via the primary rails, and wherein the drilling instrument in movable along the mast at least via the auxiliary rails.

9. The machine according to claim 8, wherein the drilling instrument is operable to move between the first and second orientations via a four-bar frame assembly.

10. The machine according to claim 1, wherein the pile cap holder comprises a sliding assembly that is configured to slide the pile cap in a direction transverse to the driving axis of the rotary driver.

* * * * *